United States Patent [19]

Uke

[11] Patent Number: 5,020,191

[45] Date of Patent: Jun. 4, 1991

[54] SNORKEL STRAP

[76] Inventor: Alan K. Uke, 5980 Rancho Diegueno, P.O. Box 8531, Rancho Santa Fe, Calif. 92067

[21] Appl. No.: 459,961

[22] Filed: Jan. 12, 1990

[51] Int. Cl.[5] ..... A44B 21/00; B63C 11/16

[52] U.S. Cl. ..... 24/3 R; 24/16 PB; 128/201.11

[58] Field of Search ..... 24/3 R, 16 PB, 17 AP, 24/30.5 P, 453; 128/201.11

[56] References Cited

U.S. PATENT DOCUMENTS

| | | | |
|---|---|---|---|
| 370,289 | 9/1887 | Brombacher | 24/16 PB |
| 2,936,980 | 5/1960 | Rapata | 24/17 AP |
| 3,059,359 | 10/1962 | Goldammer et al. | 24/16 PB |
| 3,157,421 | 11/1964 | Nierhaus | 24/16 PB |
| 3,233,801 | 2/1966 | Schulenberg | 24/16 PB |
| 3,475,716 | 10/1969 | Laig | 24/16 PB |
| 3,502,396 | 3/1970 | Greenberg | 24/453 |
| 3,603,306 | 9/1971 | Bonin, Jr. | 128/201.11 |
| 4,046,296 | 9/1977 | McGhee | 24/3 R |
| 4,526,756 | 7/1985 | Wong | 24/16 PB |

FOREIGN PATENT DOCUMENTS

| | | | |
|---|---|---|---|
| 212610 | 2/1957 | Australia | 128/201.11 |

*Primary Examiner*—Victor N. Sakran

*Attorney, Agent, or Firm*—Brown, Martin Haller & McClain

[57] ABSTRACT

A strap for removably attaching a snorkel to a diving mask having a ring and a T-shaped strap defined by a pair of arms and a leg perpendicular to the arms with the outer end of the leg coupled to the ring. A coupling device mounted upon the arms is used to removably couple the arms together at the outer ends thereof so as to form an additional ring.

5 Claims, 1 Drawing Sheet

SNORKEL STRAP

BACKGROUND OF THE INVENTION

The present invention relates to diving equipment. More specifically the present invention relates to a novel and improved strap for removably attaching a snorkel to a diving mask.

In the sport of diving or snorkeling a strap is commonly used to attach the snorkel to the mask. The snorkel strap prevents loss of the snorkel from the mask when not in use during the dive. Snorkel straps also serve the function of maintaining the snorkel in a position for use during the dive.

The conventional snorkel strap consists of a pair of rings joined by a strap at the peripheral edges thereof. Both rings fit over the snorkel tube with the mask strap fitting between the snorkel and the strap as coupled to the snorkel by the rings. The mask strap and snorkel strap are typically formed of flexible and elastic like materials such as rubber. There are various other well-known configurations for the snorkel strap although the just described strap is most common.

The conventional snorkel strap does not readily facilitate separation of the snorkel from the mask for purposes such as cleaning, storing or transporting. Using the conventional snorkel strap, the strap must be slid on the tube toward an end of the snorkel opposite the mouthpiece. One ring is removed so as to free the mask from the tube. In the alternative, the mask strap may be decoupled from the dive mask at one end thereof so as to separate the mask from the snorkel. However, this removal technique typically causes loss of the mask strap adjustment.

Due to the inconvenience in the just described separation techniques, it is desirable to have a snorkel strap which facilitates quick and easy detachment of the snorkel from the mask. Various schemes have been implemented to facilitate such separation but have involved elaborate and complex designs. One such design requires the use of a VELCRO coupling arrangement for attaching the snorkel to the mask. However, such designs are rather cumbersome and quite detracting from using.

It is therefore an object of the present invention to provide a novel and improved snorkel strap for facilitating removable coupling of a snorkel to a mask.

SUMMARY OF THE INVENTION

The present invention is a novel and improved snorkel strap formed of a flexible and elastic material. The strap consists of a ring and a T-shaped strap defined by a pair of arms and a leg perpendicular to the arms. An outer end of the leg is coupled to the rings. A coupling means is mounted upon the T-shaped strap arms for removably coupling the arms together at the outer ends thereof so as to form an additional ring. The T-shaped strap and ring are typically integrally formed from a flexible and elastic material such as a thermoplastic material. The coupling means typically comprises a hole formed at an outermost end of one of the arms while mounting a button at an outermost end of the other arm.

In use the ring is positioned over the snorkel tube while the mask strap is placed above the ring. The arms are placed in an overlapping position with the mounted button fitting within the hole. The arm formed ring encircles the snorkel tube, so along with the ring and leg capture the mask strap against the snorkel tube. The use of a button arrangement readily permits coupling of the arms and ease for user detachment of the snorkel from the mask.

BRIEF DESCRIPTION OF THE DRAWINGS

The features, objects and advantages of the present invention will become more apparent from the detailed description of the preferred embodiment of the present invention in which like reference characters correspond throughout and wherein.

DETAILED DESCRIPTION OF THE PREFERRED EMBODIMENT

Figure 1:
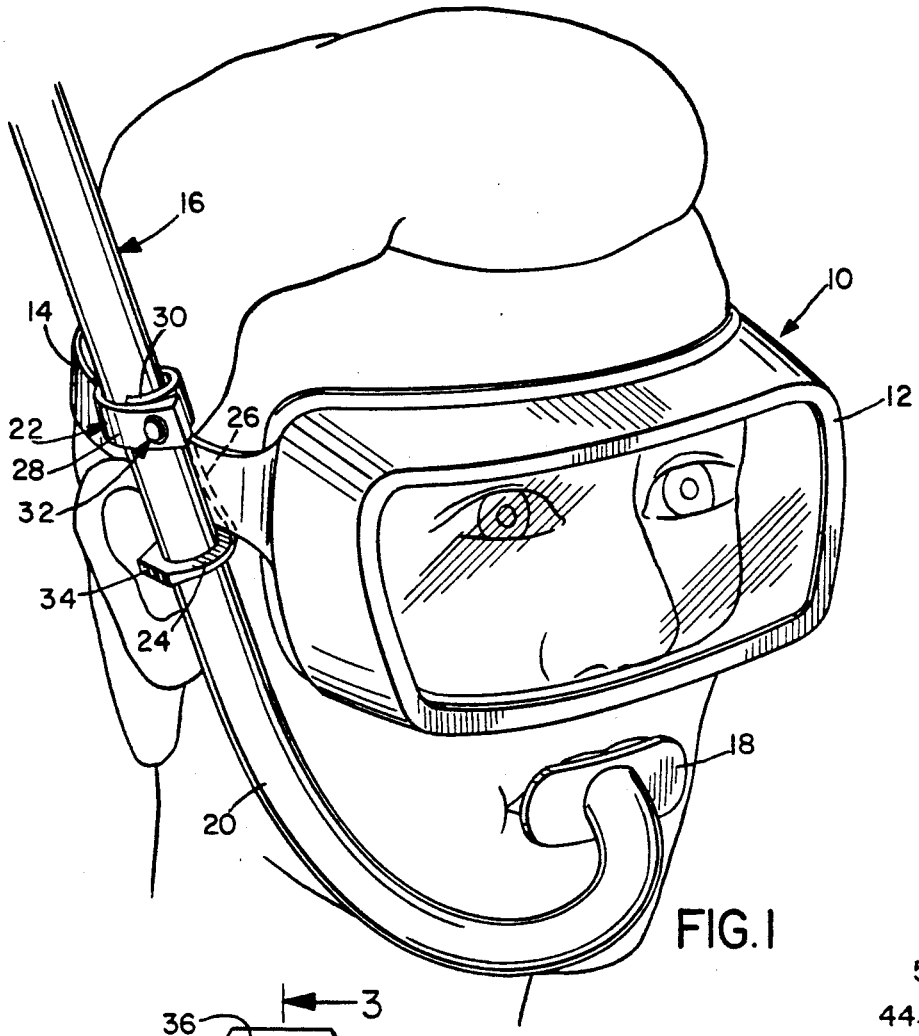
FIG. 1 is a perspective view illustrating the snorkel strap in use.

Turning now the drawings, in FIG. 1 the snorkel strap of the present invention is illustrated in use. In FIG. 1 A diver is illustrated wearing a diving mask in which is comprised of a face portion 12 which is contained in secure placement against the diver's face by strap 14. The diver uses a snorkel 16 which is comprised of a mouthpiece 18 that is coupled to tube 20.

Snorkel strap 22 is of the design preferred for the present invention. Strap 22 is comprised of a ring 24 which is slipped over the end of the snorkel tube 20 opposite mouthpiece 18 and slid down into position as illustrated. Snorkel strap 22 includes a strap 26 coupled at one end thereof to ring 24. At the other end of strap 26 are a pair of arms 28 and 30 perpendicular to strap 26 which encircle tube 20. In the arrangement as illustrated in FIG. 1, mark strap 14 is captured by strap 26 as held by ring 24 and arms 28 and 30 to tube 20 so as to maintain snorkel 16 in position with respect to mask 10. Arms 28 and 30 are overlapping and coupled together by a coupling means, such as the button or stud arrangement 32. Button arrangement 32 facilitates ease in removal and attachment of the arms 28 and 30 while providing secure coupling thereof.

Figure 2:
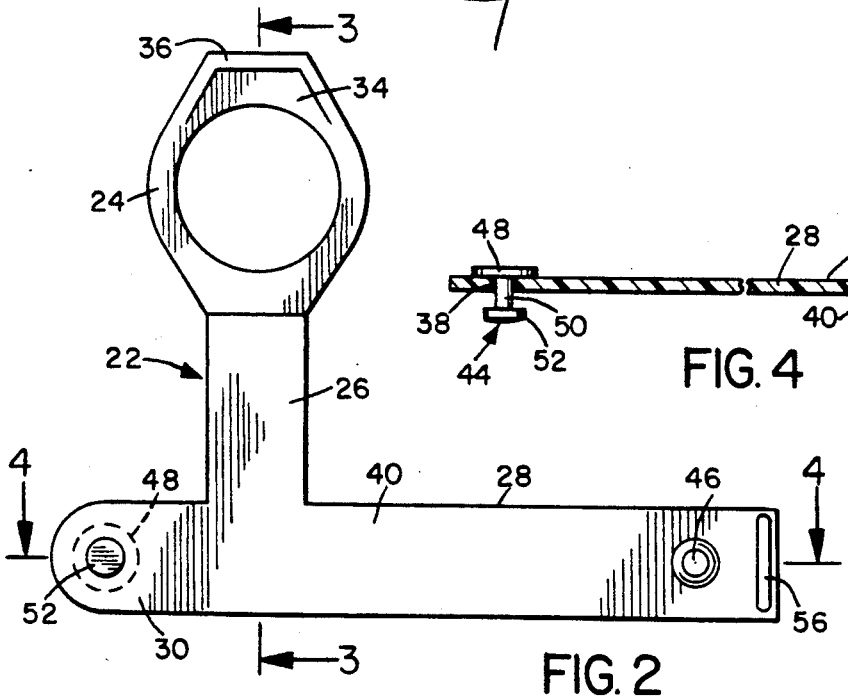
FIG 2 is a plan view of the snorkel strap in a flat configuration.

FIG. 2 illustrates snorkel strap 22 of the present invention in a flat configuration. In FIG. 2 ring 24 typically has an outer diameter of approximately $1\frac{5}{8}''$ and an inner diameter of 15/16". At the edge peripheral thereof ring 24 includes a tab portion 34 which extends radially outward therefrom. Tab portion 34 tapers in width as it extends outwardly from ring 24. Tab portion 34 extends from an inner edge of the opening of ring 24 approximately $\frac{1}{2}''$ and is squared off at the outermost edge thereof. Tab portion 34 includes a ridge 36 integrally formed on a top surface 40 of tab portion 34.

Integrally formed at an edge of ring 24 opposite tab portion 34 is strap 26. Strap 26 is approximately $1\frac{1}{8}''$ in length and $\frac{5}{8}''$ in width. At the end of strap 26 opposite ring 24 a pair of in-line arms 28 and 30 which are perpendicular to strap 26. Arms 28 and 30 in conjunction with strap 26 to define a T-shaped strap.

Arms 28 and 30 span a length approximately $4\frac{1}{2}''$ and are approximately 11/16" in width. Arm 30 is approximately $1\frac{1}{4}''$ in length from an outermost edge thereof to midway of the intersection with strap 26. Similarly, arm 28 is approximately $3\frac{1}{4}''$ in length from an outermost edge thereof to the middle of the intersection of strap 26.

Snorkel strap 22 has typically a rectangular cross-section with flat upper, lower and side surfaces. Typically ring 24 and tab portion 34 are a slightly greater in thickness than the remaining portions of snorkel strap 22. Mounted in hole 38 adjacent the end of arm 30, hole 38 extending from upper to lower surfaces 40 and 42 (lower surface is better illustrated in FIG. 4) is button or stud 44. Positioned at an outermost end of arm 28 is hole 46. Hole 46 is used to receive button 44 when the strap overlaps in a ring-like configuration. The region surrounding hole 46 is slightly enlarged in thickness.

Figure 3:
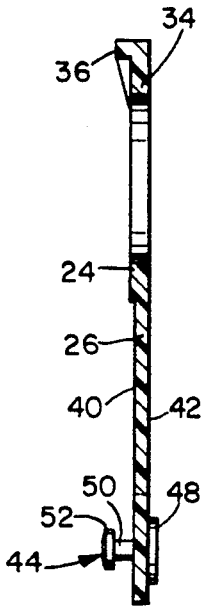
FIG. 3 is a sectional view taken on line 3—3 of FIG. 2.

Referring now to FIG. 3, a cross-section taken along line 3—3 of FIG. 2, the snorkel strap is illustrated in further detail. The overall length from tab portion 34 to the outermost side or edge of arms 28 and 30 is approximately 3⅜". As illustrated in FIG. 3, ridge 36 increases slightly in thickness as tab portion 34 extends outward from the inner opening of ring 24. At the end of tab portion 34, tab 36 is of a constant thickness typically 3/16" thick and 3/32" in width. Ring 24 is typically approximately ⅛" thick while strap 26 and arms 28 and 30 are typically 3/32" thick.

Button 44 is comprised of a retention or disk 48 integrally formed with a smaller interconnecting or post 50 which has at an opposite end therein a second retention cylinder or knob 52.

Figure 4:
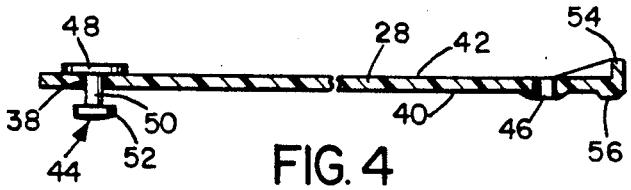
FIG. 4 is a sectional view taken on line 4—4 of FIG. 2.

Referring now to FIG. 4 the center to center distance between holes 38 and 46 is approximately 3⅝". Hole 38 is approximately 3/32" in diameter and located approximately 5/16" from the end of arm 30 and centered across the width thereof. Hole 46 is approximately ⅛" in diameter and also centered across the width of arm 28 in line with hole 38. Hole 38 is slightly smaller than hole 46 so as to facilitate retention of button 44 therein.

Disk 48 of button 44 is approximately 1/16" in thickness and ⅜" in diameter. Integrally formed with disk 48 is interconnecting post 50 which is approximately 3/16" in length and approximately ⅛" in diameter. Integrally formed at the opposite end of post 50 is knob 52 which is approximately 3/32" in height and ¼" in width.

At the outermost end of arm 28 is formed a ridge 54 similar to that of ridge 36. Ridge 54 increases in thickness at the edges of arm 28 upon surface 42 to reach a thickness at the outermost edges thereof of approximately 3/16". Ridge 54 is also approximately 3/32" in width. Formed upon surface 40 opposite ridge 54 (FIGS. 1 and 4) is a lateral ridge 56 which extends across the width of arm 30.

In use of snorkel strap 22 the strap arms 28 and 30 are coupled together in an overlapping position by button 44. With particular reference to FIG. 4, arm 28 is rotated in a counterclockwise so as to overlap the end of arm 30 with surface 40 facing surface 42. Hole 46 is then expanded by stretching it over knob 52 and rests upon post 50. Arms 28 and 30 are thus retained in the overlapping position by knob 52.

In the preferred embodiment of the invention, ring 24, strap 26 and arms 28 and 30, along with tab portion 34 are integrally formed from a flexible and elastic material capable of stretching and yet returning to its original state. Such materials which strap 22 may be fabricated from include thermoplastic or rubber materials. Button 44 is typically integrally formed from a rigid material such as plastic.

The present invention provides the unique ability to permit the user to readily attach and detach a snorkel from a mask. The present invention provides in a design which provides secure but yet removable coupling of the snorkel to the mask, and that is superior to previous designs.

The previous description of the preferred embodiment is provided to enable any person skilled in the art to make or use the present invention. Various modifications to this embodiment will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and novel features disclosed herein.

I claim:

1. A snorkel strap for removably attaching a snorkel to a diving mask comprising:

a substantially flat ring member;

an elongated substantially flat first strap member coupled at one end to a peripheral edge of said ring member and extending radially therefrom;

an elongated substantially flat second strap member coupled at a side thereof to another end of said first strap, said first and second straps oriented substantially perpendicular to one another;

said ring member and said first and second strap members being integrally formed of a flexible material;

coupling means mounted upon said second strap member for overlapping coupling of the ends of said second strap;

said coupling means comprising first and second holes respectively formed in s aid second strap member adjacent opposite ends thereof, and a button member formed of a rigid material mounted in one of said first and second holes, said button member for also removably fitting within said other one of said first and second holes; and a tab member integrally formed of said flexible material at said ring member peripheral edge opposite said first strap member.

2. The snorkel strap of claim 1 wherein said ring and first and second strap members have a substantially rectangular cross-section and have flat outer surfaces.

3. The strap as claimed in claim 1, wherein said button member is of rigid material having buttons of larger diameter than said respective holes at its opposite ends and a reduced diameter shaft portion connecting said buttons, said button member being mounted with its shaft portion extending through one of said holes, and one of said buttons comprising means for forcibly fitting through the other hole with the opposite ends of said second strap member in overlapping relationship.

4. The strap as claimed in claim 1, wherein said first strap member is closer to one end of said second strap member than the other end.

5. The snorkel strap of claim 1 wherein said second strap member further comprises a tab portion formed at one end thereof opposite said mounting of said button member, said tab portion defined by a thickening of said second strap member at the edges thereof.

* * * * *